United States Patent [19]

Stevens

[11] 4,319,696

[45] Mar. 16, 1982

[54] ARTICLE HOLDER AND DISPENSER

[75] Inventor: Noel W. Stevens, Palo Alto, Calif.

[73] Assignee: Safe-T Pacific Co., Redwood City, Calif.

[21] Appl. No.: 73,929

[22] Filed: Sep. 10, 1979

[51] Int. Cl.[3] ..... A47F 1/04; G07F 11/16

[52] U.S. Cl. ..... 221/310; 312/43

[58] Field of Search ..... 221/303, 304, 307, 308, 221/310; 312/42, 43

[56] References Cited

U.S. PATENT DOCUMENTS

| | | | |
|---|---|---|---|
| 2,261,880 | 11/1941 | Hope | 221/303 X |
| 2,365,916 | 12/1944 | Terry et al. | 221/303 |
| 3,407,966 | 10/1968 | Gauffin | 221/303 |

FOREIGN PATENT DOCUMENTS

| | | | |
|---|---|---|---|
| 218824 | 4/1958 | Australia | 221/310 |
| 485375 | 10/1953 | Italy | 221/304 |

*Primary Examiner*—Allen N. Knowles

*Attorney, Agent, or Firm*—Flehr, Hohbach, Test

[57] ABSTRACT

An article holder and dispenser including a vertically extending elongate hollow container especially suitable for storing and dispensing a stack of nested articles such as ice-cream cones, cups and the like is disclosed herein along with a particular article release arrangement at the discharge end of the container. This arrangement utilizes a plurality of article retaining elements having upper gripping portions and lower supporting portions, the latter being adapted to engage the lowermost article in the stack for releasably retaining the engaged article and the rest of the stack within the container. The support portions of the article retaining elements are supported for movement against the urging of the lowermost article as the latter is withdrawn from the housing through its discharge opening while, at the same time, the movement causes the gripping portions to engage the next adjacent article in the stack in a way which retains the latter in place above the discharge opening until the lowermost article is entirely withdrawn from the discharge opening and out of engagement with the retaining elements.

5 Claims, 7 Drawing Figures

ARTICLE HOLDER AND DISPENSER

BACKGROUND OF THE INVENTION

The present invention relates generally to article storing and dispensing apparatus of the general type including a container for storing and dispensing nested articles such as ice-cream cones, cups and the like and more particularly to an apparatus utilizing a specifically designed article release arrangement which minimizes the possibility of inadvertently withdrawing more than one article at a time.

Presently, there are many different types of prior art article storing and dispensing devices including an article release arrangement of one form or another. In some of these devices, the article release arrangements are fixed for establishing a discharge opening of fixed size. In others, the article release arrangements are adjustable for varying their associated discharge openings. Moreover, there has been a concern in the prior art for the problem of inadvertently withdrawing more than one article at a time. In one specific example, there has been an attempt to solve this problem by utilizing an array of long and short fingers fixedly positioned around and depending down from the discharge end of its container. In this arrangement, the shorter fingers are relatively stiffer at their lower ends than the lower portions of the longer fingers so as to prevent the dispensing of more than a single cup at a time. While this technique certainly discloses the desire to prevent withdrawal of more than one article at a time it does not seem any more reliable in this regard than the utilization of bristles as disclosed in some of the other arrangements. The bristles seem to function in the same general way to separate the article being withdrawn from the rest of the stack, that is, by utilizing an upper group of bristles to retain all of the articles in the stack above the one being withdrawn. Both of these approaches rely entirely on the inherent strength of their retaining means (e.g. the shorter fingers or bristles) and both are subject to wear.

As will be seen hereinafter, the present invention is directed to an article holder and dispenser utilizing an uncomplicated and economical article retaining arrangement which is purposely designed to release articles one at a time in a reliable way and without wear to or fear of failure of its article retaining components. Moreover, as will also be seen hereinafter, the article retaining arrangement disclosed herein is one which accommodates a relatively large tolerance in the size of the articles retained and also automatically indicates when the last article in the stack reaches the lowermost position.

OBJECTS AND SUMMARY OF THE INVENTION

In view of the foregoing, one general object of the present invention is to provide an uncomplicated, economical and yet reliable arrangement for releasably retaining articles such as ice-cream cones, cups and the like in the elongate hollow container of an article holder and dispenser.

A more particular object of the present invention is to provide an article retaining arrangement which reliably releases the articles one at a time and yet an arrangement having article retaining components which are not subject to wear or failure through normal use.

Another particular object of the present invention is to provide an article retaining arrangement which is designed to accommodate a relatively large tolerance in the size of the articles being releasably retained and to reduce the possibility of damage to the more fragile articles such as ice-cream cones, even though the article engaging components of the arrangement may be relatively hard.

Still another particular object of the present invention is to provide an article retaining arrangement especially suitable for light opaque containers, specifically an arrangement which automatically indicates when there is only one article left in the stack.

As will be discussed in more detail hereinafter, the article holder and dispenser disclosed herein is one which includes a vertically extending elongate hollow housing means for containing a stack of nested articles, specifically conventionally shaped ice-cream cones in a preferred embodiment. These articles are releasably retained within the housing means and above a discharge opening in the bottom of the latter by at least one but preferably a plurality of retaining means adapted to engage the lowermost article in the stack. These retaining means are movable against the urging of the lowermost article as the latter is withdrawn from the housing through its discharge opening while, at the same time, engaging the next adjacent article in the stack for retaining the latter in place above the discharge opening until the lowermost article is entirely withdrawn and out of engagement with the retaining means.

In a preferrred embodiment, as will also be discussed hereinafter, the article retaining means are supported by a resilient band means (e.g. a coil or rubber band) or other elastic spring means (e.g. a clothespin type spring) against their associated housing means and against the two lowermost articles contained in the latter for automatically accommodating a relatively large tolerance in the size variation between the articles being retained and for reducing the possibility of damage to the more fragile articles such as ice-cream cones, even though in this preferred embodiment the article engaging components of these retaining means may be relatively hard. In the same preferred embodiment, the article retaining means are not capable of retaining a single article within the housing means and, hence, automatically indicate when this situation exists which is especially valuable when the articles are hidden within a light opaque container.

DETAILED DESCRIPTION

Figure 1:
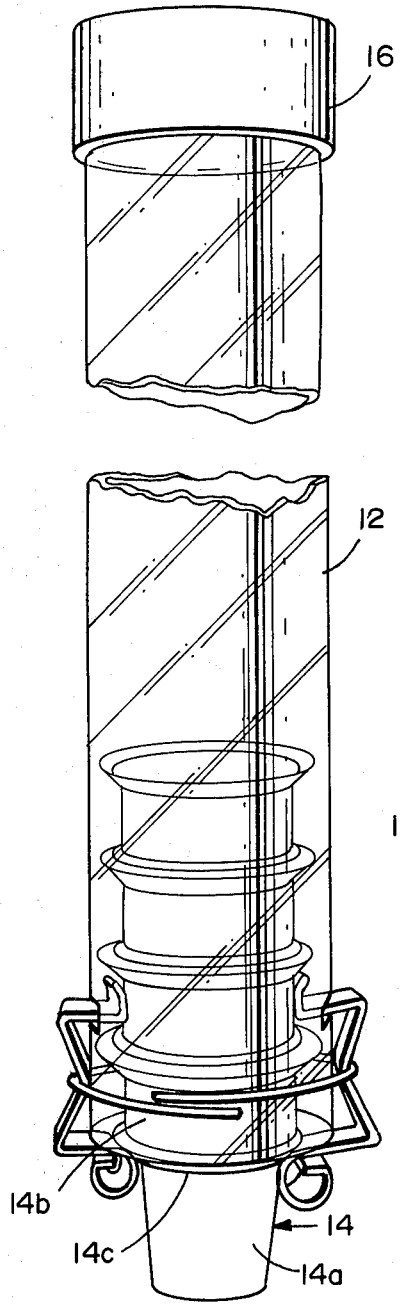
FIG. 1 is a perspective view of an article holder and dispenser which includes an arrangement for releasably retaining nested articles such as ice cream cones, cups and the like and which is designed in accordance with the present invention.

Turning to the drawings, wherein like components are designated by like reference numerals throughout the various figures, an article holding and dispensing assemlby designed in accordance with the present invention is illustrated in FIGS. 1 to 4 and generally designated by the reference numeral 10. As seen best in FIG. 1, this assembly includes an elongate hollow cylindrical tube or container 12 for storing therein a stack of nested articles such as fragile baked ice cream cones or cups, fragile drinking cups such as foam insulated cups or the like. In the embodiment illustrated, a stack of ice cream cones 14 of standard shape, that is, cones including a bottom holding section 14*a*, a larger top section 14*b* and a transverse shoulder 14*c* therebetween are maintained within the container and will be referred to throughout the following discussion. However, it is to be understood that the present invention is not limited to these particular articles.

Figure 2:
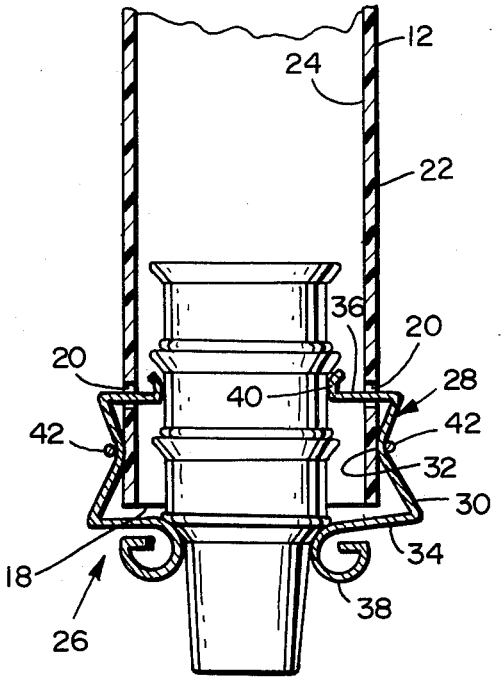
FIG. 2 is a vertical view, partially in section, illustrating how the articles, specifically ice cream cones, are retained in the container comprising part of the overall holder and dispenser.
Figure 3:
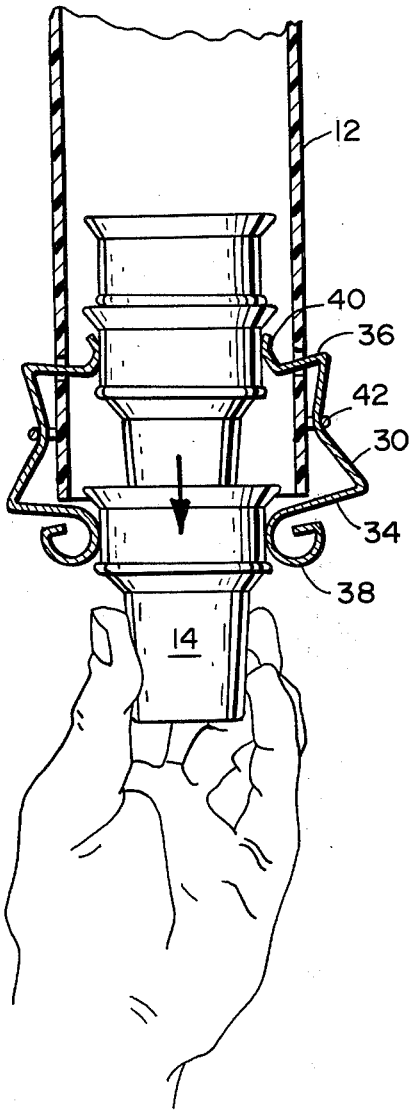
FIG. 3 is a view similar to FIG. 2, but illustrating how the lowermost cone within the container is drawn through the discharge end of the container while the next adjacent cone is retained in position above the discharge opening.
Figure 4:
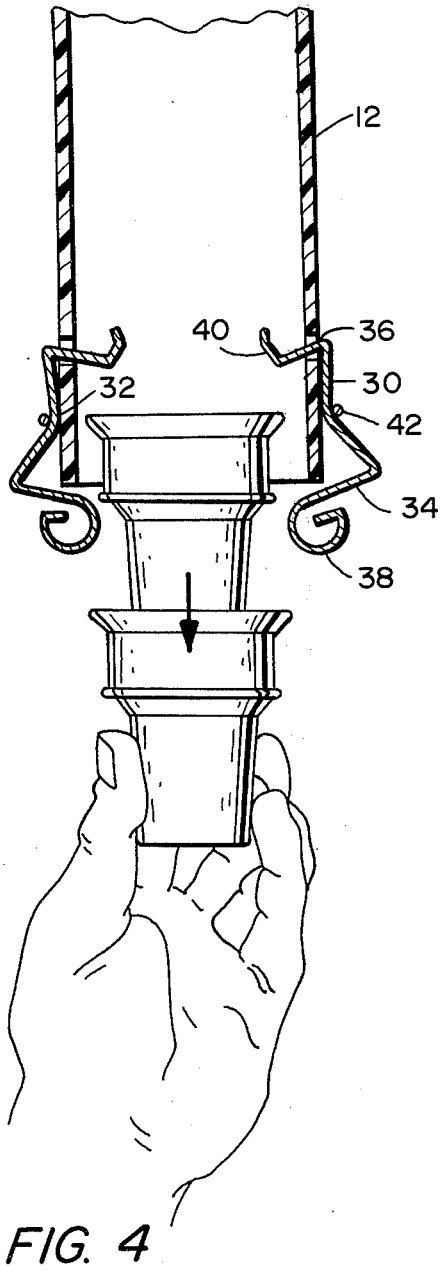
FIG. 4 is a view similar to FIGS. 2 and 3, but illustrating the effect on the article retaining arrangement when only one cone remains in the container.

In a preferred embodiment, container 12 is formed of a plastic material which may or may not be transparent and which is not necessarily flexible as required in U.S. Pat. No. 4,079,858 assigned to the assignee of the present application. However, like the container disclosed therein, container 12 may carry a top closure or cap 16 at its top end for preventing entry of foreign objects or contamination. As best seen in FIG. 2, its bottom end is open so as to provide a discharge opening generally indicated at 18 for passage of the ice cream cones 14. In addition, for reasons to be discussed hereinafter, container 12 includes a pair of through holes 20 extending from the exterior surface 22 of container 12 to its interior surface 24 diametrically opposite from one another, and a predetermined distance above discharge end 18, as best seen in FIGS. 2, 3 and 4.

While not shown, suitable means such as the supporting rings described in U.S. Pat. No. 4,079,858 may be provided for supporting the entire assembly in a fixed, vertically extending position such as the position shown in FIG. 1. In a preferred embodiment, three containers are supported on and around a single support stand.

Referring specifically to FIG. 2, assembly 10 is shown including an arrangement 26 for releasably retaining the stack of ice cream cones within container 12. As will be seen hereinafter, the arrangement not only serves to releasably retain the lowermost ice cream cone in the stack as shown in FIG. 2 but also serves to minimize the possibility of inadvertently withdrawing more than one cone at a time. In addition, this arrangement is designed to accommodate to a limited extent variations in the size of the the articles being releasably retained and to reduce the possibility of damage to the more fragile articles such as ice cream cones, even though the article engaging components of the arrangement may be relatively hard, as will be discussed hereinafter.

As shown specifically in FIG. 2, arrangement 26 includes a pair of integrally formed article retaining clips 28 which may be constructed of any suitable material for releasably retaining articles 14 in the manner to be described. In a preferred embodiment, these clips are formed from sheet metal strips sufficiently rigid to maintain a preformed shape. As seen best in FIGS. 2, 3 and 4, each clip includes a somewhat V-shaped central segment 30 having an intermediate bend or vertex at 32, a lower segment 34 projecting out from the bottom end of segment 30 and an upper segment 36 projecting out from the top end of segment 30 in the same direction as segment 34. Lower segment 34 carries a rounded article engaging end 38 while upper segment 36 carries a somewhat vertical but slightly bent back article engaging end 40.

The article retaining clips just described are connected with the bottom end of container 12 by means of a support band 42 which also comprises part of arrangement 26. As will be seen hereinafter, this band supports the clips between three different operating positions, an article retaining position shown in FIG. 2, an article withdrawing or dispensing position shown in FIG. 3, and a position distinct from the other two when only one article is left in container 12. Support band 42 on the embodiment illustrated displays a slight degree of resiliency in the radially outward direction as best seen in FIG. 3 so as to provide certain advantages to the overall arrangement, as will be pointed out below. Accordingly, the support band is comprised of an elastic loop such as a rubber band, a single annular wire of one or more windings but unconnected at its ends (so as to provide the needed resiliency or give) or the like. Referring specifically to FIG. 2, the two article retaining clips 28 are shown in their article retaining positions. In these positions, the central segment 30 of each clip is located adjacent the exterior surface 22 of container 12 between through holes 20 and discharge end 18. As seen in FIG. 2, the bend 32 actually rests against exterior surface 22 and support band 42 extends around the central segment just behind and against the bend. The lower segment 34 extends under container 12 and into discharge opening 18 such that its rounded end 38 engages the transverse shoulder 14*c* of the lowermost ice cream cone 14. Upper segment 36 extends into the container through an aligned one of the holes 20 such as its somewhat vertically extending end 40 loosely engages the top section 14*b* of the next adjacent cone.

Turning now to FIG. 3, the lowermost ice cream cone is shown being withdrawn from container 12 through discharge opening 18. As seen there, the lower segments 34 of retaining clips 28 are forced outward against the urging of the lowermost cone (actually its top section) as the latter is withdrawn from the container through the discharge opening. This causes the central segments 30 to move out away from the exterior surface of container 12 which, in turn, causes the support band 42 to expand radially outward. At the same time, the upper segments 36 are urged inward in tight engagement with the top section of the next adjacent cone so as to retain the latter in place above the discharge opening until the lowermost cone is entirely withdrawn from the latter and out of engagement with the lower segments. At that time, the article retaining clips move back to their article retaining positions shown in FIG. 2, allowing the next adjacent cone to fall into the position of the lowermost cone.

From the foregoing, it should be apparent that the arrangement 26 comprised of article retaining elements 28 and support band 42 releasably retains ice cream cones 14 within container 12 while at the same time, insuring that there is only one article released at a time from the container. However, it should be equally apparent that the resiliency or give in support band 42 allows ice cream cones of different sizes to a limited extent to be withdrawn through the discharge opening. For example, if the diameter of the top section 14*b* of the lowermost cone shown in FIG. 3 is slightly greater than that shown, the support band would be forced outward a slightly greater distance than that shown. On the other hand, if its diameter were slightly less than that shown, the band would not expand quite as far outward. In either case, the give in the support band accommodates these differences in size. This give also reduces the amount of force exerted by the top segment of each article retaining clip against the next adjacent cone for reducing the possibility of damage to the latter. More specifically, because of the give in support band 42, the movement of each article retaining clip is not rigidly fixed regardless of variations in the size of either the lowermost article being withdrawn or the next adjacent article being retained, but rather can move outward away from container 12 to accommodate the size variations in these articles. In this way, the engaging ends of the article retaining clips do not necessarily have to be soft or otherwise pliable to prevent damage to the cones.

The foregoing description of arrangement 26 presupposed the existence of a lowermost ice cream cone and the next adjacent cone. FIG. 4 on the other hand illustrates the movement of the article retaining clips when there is only one cone remaining in container 12. As seen there, there is no next adjacent cone to prevent the article engaging ends 40 of upper segment 36 from moving inward towards one another. This inward movement causes the article engaging ends 36 of lower segments 34 to move outward, thereby causing the last cone to fall downward from the container. It is quite possible to prevent this from occurring, for example by biasing the clips in their article retaining positions by means of band 42 or a second band. For example the band 42 (or another band) could be located closer to end 38 than end 40. However, in a preferred embodiment, such biasing means are not utilized. Rather, the last cone is allowed to automatically move out of the container so as to indicate that there are no remaining cones therein. This is especially helpful when the container is opaque and, hence, does not itself indicate when it is empty.

Having described overall holding and dispensing assembly 10, it should be apparent that certain modifications can be made without departing from the spirit of the present invention. For example, arrangement 26 could utilize more than two article retaining clips. The exact shape of each clip could vary from the shape illustrated. For example, each clip could be shaped such that it is biased in its article retaining position (as discussed above) thereby eliminating the feature just described with respect to FIG. 4.

Figure 5:
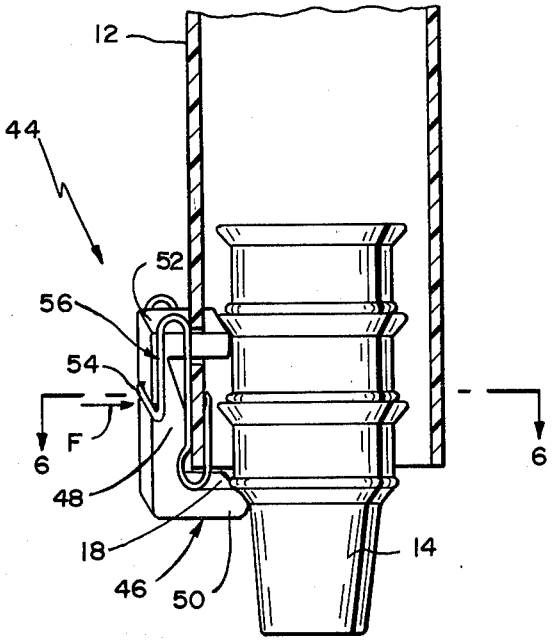
FIG. 5 is a broken away perspective view of an article holder and dispenser including a modified arrangement for releasably retaining nested articles.
Figure 7:
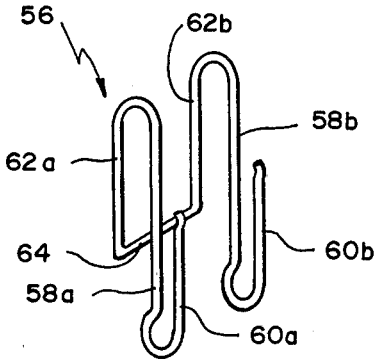
FIG. 7 is a perspective view of a spring clip comprising part of the modified arrangement illustrated in FIG. 5 and 6.
Figure 6:
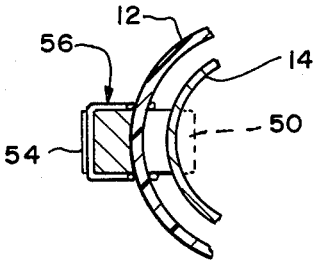
FIG. 6 is a section view of a part of the holder and dispenser of FIG. 5 taken generally along line 6—6 in FIG. 5.

Turning now to FIGS. 5, 6 and 7, a modified arrangement for releasably retaining the stack of ice cream cones 14 within a container 12 is illustrated. This arrangement, which is generally indicated at 44, functions in the same way as arrangement 26 but does not utilize exactly the same type of article retaining clip (although the clip used functions in the same manner) and it does not utilize a single support band 42, as will be seen below. One of the clips utilized in arrangement 44 is shown in FIG. 5 and indicated at 46. This clip is an integrally formed member in a preferred embodiment, specifically on which is integrally formed into the shape illustrated in FIG. 5 by means of extrusion. In a preferred embodiment clip 46 is comprised of a lengthwise section of a continuous plastic extrusion.

As stated above, clip 46 functions in the same manner as previously described clips 28. Accordingly, clip 46 includes a central segment 48 which corresponds to previously described segment 30 of clip 28, a lower segment 50 corresponding to lower segment 34 and its engaging end 38 of clip 28 and an upper segment 52 corresponding to segment 36 and its engaging end 40. For reasons to be discussed below, the back end of intermediate segment 48 includes a transverse slot 54.

As seen in FIG. 5, clip 46 is positioned against the lowermost section of container 12 such that the innermost surface of its intermediate section 48 rests against the outer surface of the container, such that its lowermost section projects into the opening 18 of the container and such that its upper section extends into the cooperating through hole 20, all in the same manner as described previously with respect to corresponding clip 28. The way in which clip 50 releasably retains a lowermost article 14 and the next adjacent article is also the same. Moreover, while only one such clip is shown, it should be obvious that more than one could be included in overall arrangement 44.

As stated previously, arrangement 44 does not include a single continuous band such as the band 42. Rather, as seen in FIGS. 5–7, a spring clip 56 is associated with article retaining clip 46. One such clip is shown in FIGS. 5–7 and generally designated at 56. As best seen in FIG. 7, this spring clip is a single continuous member having opposite legs 58*a* and 58*b* which are turned up at their bottom ends at 60*a* and 60*b*, respectively, and at their top ends at 62*a* and 62*b*, respectively. The lowermost free ends of the turned down sections 62*a* and 62*b* are joined together by a single cross link 64. As seen best in FIG. 5, spring 56 is assembled to the bottom end of container 12 by positioning the turned up ends 60*a* and 60*b* in engagement with the bottom end of the container. In this way legs 58*a* and 58*b* extend up, across and against the outer surface of container 12 from its bottom end, on opposite sides of article containing clip 46. The cross link 64 is positioned within previously described cross slot 54. With the spring clip in this position, the cross link 64 exerts a biasing force against the intermediate section of clip 46 in the direction of arrow F, in the same manner as previously described band 42. Moreover, the clip provides a limited degree of resiliency so as to allow radially outward movement of intermediate section 48 similar to the outward movement of clip 28 (FIG. 3) as the cone is drawn out of the container.

What is claimed is:

1. An article holder and dispenser for storing dispensing nested articles such as ice cream cones, cups and the like including articles of the type having a top section, a smaller bottom section and an intermediate transverse shoulder, said article holder and dispenser comprising a vertically extending cylindrical, hollow housing for containing a stack of said nested articles, said housing defining a discharge opening at its bottom end for passage of said contained articles and a plurality of through holes circumferentially spaced around its periphery a predetermined distance above said discharge opening, and an arrangement for releasably retaining said stack within said housing, said arrangement including an equal plurality of integral article retaining clips, each of which includes a central segment located adjacent the exterior of said housing between said through holes and discharge opening, a lower segment extending under said container and into said discharge opening for engagement with the transverse shoulder of the lowermost article prior to withdrawal of the latter from said container and an upper segment extending into said container through a corresponding one of said through holes for loose engagement with the top section of the next adjacent article prior to withdrawal of the lowermost article, and resilient means bearing radially inwardly against the outer surfaces of the central segments of said clips such that the lower segments of latter are movable outward against the urging of said lowermost article as the latter is withdrawn from said housing through said discharge opening while, at the same time, said central segments are urged outwardly and said upper segments are urged inward for tightly engaging the top section of the next adjacent article and retaining the latter in place above the discharge opening until the lowermost article is entirely withdrawn from the latter and out of engagement with said lower segments.

2. An article holder and dispenser according to claim 1 wherein said resilient means consists of a single continuous band around the intermediate segments of all of said clips.

3. An article holder and dispenser according to claim 1 wherein said resilient means includes a spring clip for each of said retaining clips, each spring clip including a segment thereof frictionally engageable with a bottom section of said housing for connecting its associated retaining clip with said housing.

4. An article holder and dispenser for storing and dispensing nested articles such as ice cream cones, cups and the like including articles of the type having a top section and a smaller bottom section, said article holder and dispenser comprising a vertically extending cylindrical, hollow housing for containing a stack of said nested articles, said housing defining a discharge opening at its bottom end for passage of said contained articles and a plurality of through holes circumferentially spaced around its periphery a predetermined distance above said discharge opening, and an arrangement for releasably retaining said stack within said housing, said arrangement including an equal plurality of integral article retaining clips, each of which includes a central segment located adjacent the exterior of said housing between said through holes and discharge opening, a lower segment extending under said container and into said discharge opening for engagement with a portion of the lowermost article below its top section prior to withdrawal of the latter from said container and an upper segment extending into said container through a corresponding one of said through holes for loose engagement with a section of the next adjacent article prior to withdrawal of the lowermost article, and a single resilient band extending around and bearing radially inwardly against the outer surfaces of all of the central segments of said clips such that the lower segments of latter are movable outward against the urging of said lowermost article as the latter is withdrawn from said housing through said discharge opening while, at the same time, said upper segments are urged inward for tightly engaging the top section of the next adjacent article and retaining the latter in place above the discharge opening until the lowermost article is entirely withdrawn from the latter and out of engagement with said lower segments.

5. An article holder and dispenser for storing and dispensing nested articles such as ice cream cones, cups and the like including articles of the type having a top section and a smaller bottom section, said article holder and dispenser comprising a vertically extending cylindrical, hollow housing for containing a stack of said nested articles, said housing defining a discharge opening at its bottom end for passage of said contained articles and a plurality of through holes circumferentially spaced around its periphery a predetermined distance above said discharge opening, and an arrangement for releasably retaining said stack within said housing, said arrangement including an equal plurality of integral article retaining clips, each of which includes a central segment located adjacent the exterior of said housing between said through holes and discharge opening, a lower segment extending under said container and into said discharge opening for engagement with a portion of the lowermost article below its top section prior to withdrawal of the latter from said container and an upper segment extending into said container through a corresponding one of said through holes for loose engagement with the top section of the next adjacent article prior to withdrawal of the lowermost article, and resilient means bearing radially inwardly against the outer surfaces of the central segments of said clips such that the lower segments of latter are movable outward against the urging of said lowermost article as the latter is withdrawn from said housing through said discharge opening while, at the same time, said central segments are urged outwardly and said upper segments are urged inward for tightly engaging the top section of the next adjacent article and retaining the latter in place above the discharge opening until the lowermost article is entirely withdrawn from the latter and out of engagement with said lower segments, said resilient means including a spring clip for each of said retaining clips, each spring clip including a segment thereof frictionally engagable with a bottom section of said housing for connecting its associated retaining clip with said housing.

* * * * *